US008091746B2

(12) United States Patent
Gotler

(10) Patent No.: US 8,091,746 B2
(45) Date of Patent: Jan. 10, 2012

(54) TAMPER-EVIDENT CONTAINER WITH POUR-OUT CONTAINER FITMENT

(76) Inventor: David Gotler, West New York, NJ (US)

( * ) Notice: Subject to any disclaimer, the term of this patent is extended or adjusted under 35 U.S.C. 154(b) by 357 days.

(21) Appl. No.: 12/381,908

(22) Filed: Mar. 17, 2009

(65) Prior Publication Data

US 2009/0294488 A1 Dec. 3, 2009

Related U.S. Application Data

(60) Provisional application No. 61/130,228, filed on May 29, 2008.

(51) Int. Cl.
*B65D 5/72* (2006.01)

(52) U.S. Cl. ..... 222/569; 222/109; 222/482; 222/544; 222/571; 215/41; 220/789

(58) Field of Classification Search ..... 222/109, 222/478, 481, 482, 541.6, 544, 547, 566–572; 215/41, 235, 237; 220/203.13, 573.4–573.5, 220/784, 787, 789, 912
See application file for complete search history.

(56) References Cited

U.S. PATENT DOCUMENTS 2,069,089 A * 1/1937 Goldman et al. ..... 220/703
2,848,145 A 8/1958 Livingstone
3,217,935 A * 11/1965 Burt ..... 222/109
3,309,000 A * 3/1967 Haverstick ..... 222/569
3,311,275 A * 3/1967 Gibson ..... 222/567
3,361,307 A * 1/1968 Clare ..... 222/489
3,429,488 A 2/1969 Micallef
3,693,847 A * 9/1972 Gibson ..... 222/546
3,813,009 A * 5/1974 Lenz ..... 222/90
3,980,211 A * 9/1976 Owens ..... 222/478
4,142,659 A 3/1979 Petersson
4,567,993 A * 2/1986 Albrecht et al. ..... 215/252
4,600,131 A * 7/1986 Roof et al. ..... 222/478
5,730,045 A * 3/1998 Delaquis et al. ..... 99/337
5,899,354 A * 5/1999 Garcia ..... 220/669
6,845,887 B1 * 1/2005 Granger et al. ..... 222/153.06
6,983,862 B2 1/2006 Nottingham et al.
7,014,075 B2 3/2006 Bonifacio et al.

* cited by examiner

*Primary Examiner* — Kevin P Shaver
*Assistant Examiner* — Andrew Bainbridge
(74) *Attorney, Agent, or Firm* — Ober, Kaler, Grimes & Shriver; Royal W. Craig

(57) ABSTRACT

A tamper-evident container with pour-out container fitment for frictional engagement within the cylindrical neck of a container to control and meter the flow of liquids out of the container. The fitment includes a top flange sufficient to cover the mouth of the container and a coaxial cylindrical insert extending from the top flange into the neck. The fitment is held into the neck by friction and a ring extends from the insert for enhanced frictional engagement. Apertures are provided in the insert to allow fluid to pass into the interior of the insert, and channels are provided along the walls of the interior from the apertures to the top flange to guide the liquid from the apertures to the flange.

15 Claims, 5 Drawing Sheets

TAMPER-EVIDENT CONTAINER WITH POUR-OUT CONTAINER FITMENT

CROSS-REFERENCE TO RELATED APPLICATIONS

The present application derives priority from provisional application 61/130,228 filed on May 29, 2008, which is incorporated herein by reference.

BACKGROUND OF THE INVENTION

1. Field of the Invention

The present invention relates to containers and, in particular, to tamper-evident, pour-control fitments for containers.

2. Description of the Background

When pouring liquids from containers with a cylindrical neck, such as bottles, the liquid flow varies greatly with very small changes in the angle of the container. Consequently, controlling the flow rate or the volume of liquid dispensed can be very difficult. Nevertheless, a smooth and closely-controlled flow is of paramount importance in some situations, for example, in dispensing medicines, ingredients used in cooking, or concentrated aromatic oils. In addition, certain liquids are so expensive that even the loss of a drop or two of the liquid is to be avoided. This presents a design challenge because any effort to volumetrically limit the flow will have a tendency to disrupt the flow, resulting in a difficult and uneven pour. Therefore, an improved container configuration is needed to provide for both controlled flow of liquid being dispensed from the container while also providing a smooth flow.

There have been prior efforts to provide containers, and specifically bottles, with necks or apertures that limit the flow of liquid.

For example, U.S. Pat. No. 3,429,488 to Micallef issued Feb. 25, 1969, shows a surge proof bottle with a plastic insert that fits within the neck of the bottle and has a flared rim for limiting insertion into the bottle. The bottom of the insert is defined by peripheral apertures to allow a limited flow of liquid to enter the insert.

U.S. Pat. No. 6,983,862 to Nottingham et al. issued Jan. 10, 2006, shows a container and lid assembly with a screw-on pour spout.

U.S. Pat. No. 7,014,075 to Bonifacio et al. issued Mar. 21, 2006, shows a flow regulator insert for bottles that fits within the neck. This flow regulator includes at least a two-part device with orifices that can be moved relative to each other. The degree of overlap between the respective orifices defines a common dispensing area that controls the flow rate during content dispensing.

U.S. Pat. No. 3,311,275 to Gibson issued Mar. 28, 1967, shows a flow control bottle cap with a plastic insert that fits within the neck of the bottle and has a flared rim for limiting insertion into the bottle. The bottom of the insert is defined by peripheral apertures to allow a limited flow of liquid to enter the insert. A threaded cap fits overtop the insert.

U.S. Pat. No. 3,980,211 to Owens issued Sep. 14, 1976, shows a pouring adaptor that mounts over the open end in a container. A plastic flow control insert fits over the neck of the bottle, and a threaded cap fits overtop the insert.

U.S. Pat. No. 4,142,659 to Petersson issued Mar. 6, 1979, shows a drawing-off tube inserted in the neck of a bottle. A threaded cap fits overtop the insert, and when the cap is removed, the tube can be extended.

U.S. Pat. No. 6,845,887 to Granger et al. issued Jan. 25, 2005, shows a spill-proof pouring plastic insert that fits within the neck of the bottle and has a flared rim for pouring. The bottom of the insert is defined by peripheral apertures that allow a limited flow of liquid to enter the insert. A threaded cap fits overtop the insert.

U.S. Pat. No. 2,848,145 to Livingstone issued Aug. 19, 1958, shows a pouring adapter that fastens to the neck of a bottle having a plastic insert that fits within the neck and a flared rim for pouring. A threaded cap fits overtop the insert.

U.S. Pat. No. 4,567,993 to Albrecht issued Feb. 4, 1986, shows a tamper-evident closure with frangible band that falls freely around a neck portion of the container to provide evidence that the container has been previously opened.

While the foregoing prior art speaks to the broad concept of a bottle with insert-baffle for flow control, it fails to approach the problem of smoothing the flow.

SUMMARY OF THE INVENTION

In accordance with exemplary embodiments of the present invention, a tamper evident pour-out container, cap, and internal fitment combination is provided to improve pourability. The tamper-evident internally-threaded plastic cap has a ring joined to the bottom. The ring is minimally attached to the main body of the cap and has a series of inwardly-protruding ribs that engage the lower neck of the container. As the cap is unscrewed the ring will break-away to indicate that the container has been opened. A distinct cap-container thread is also provided.

In addition, a plastic insert fitment is provided that fits within the neck of the container, beneath the cap. The fitment is formed as a cylindrical receptacle with a top annular flange for limiting insertion into the container neck. For smoother pouring, channels are molded into the sides of the insert, extending from the bottom to the top. The cylindrical receptacle has one or more small apertures at the bottom of the insert to meter entry of liquid into the hollow of the receptacle. The radial placement of the aperture(s) conforms to that of the channels so that the metered flow of liquid entering the insert will flow along the channels. This placement and combination enhances the ability of the fitment to control and meter the flow of liquid out of the container. There are also defined pouring spouts on opposing sides of the annular top flange. This achieves a smooth and closely-controlled flow especially suitable for dispensing medicines and ingredients used in cooking, and for perfume dispensing applications.

DETAILED DESCRIPTION

Figure 1:
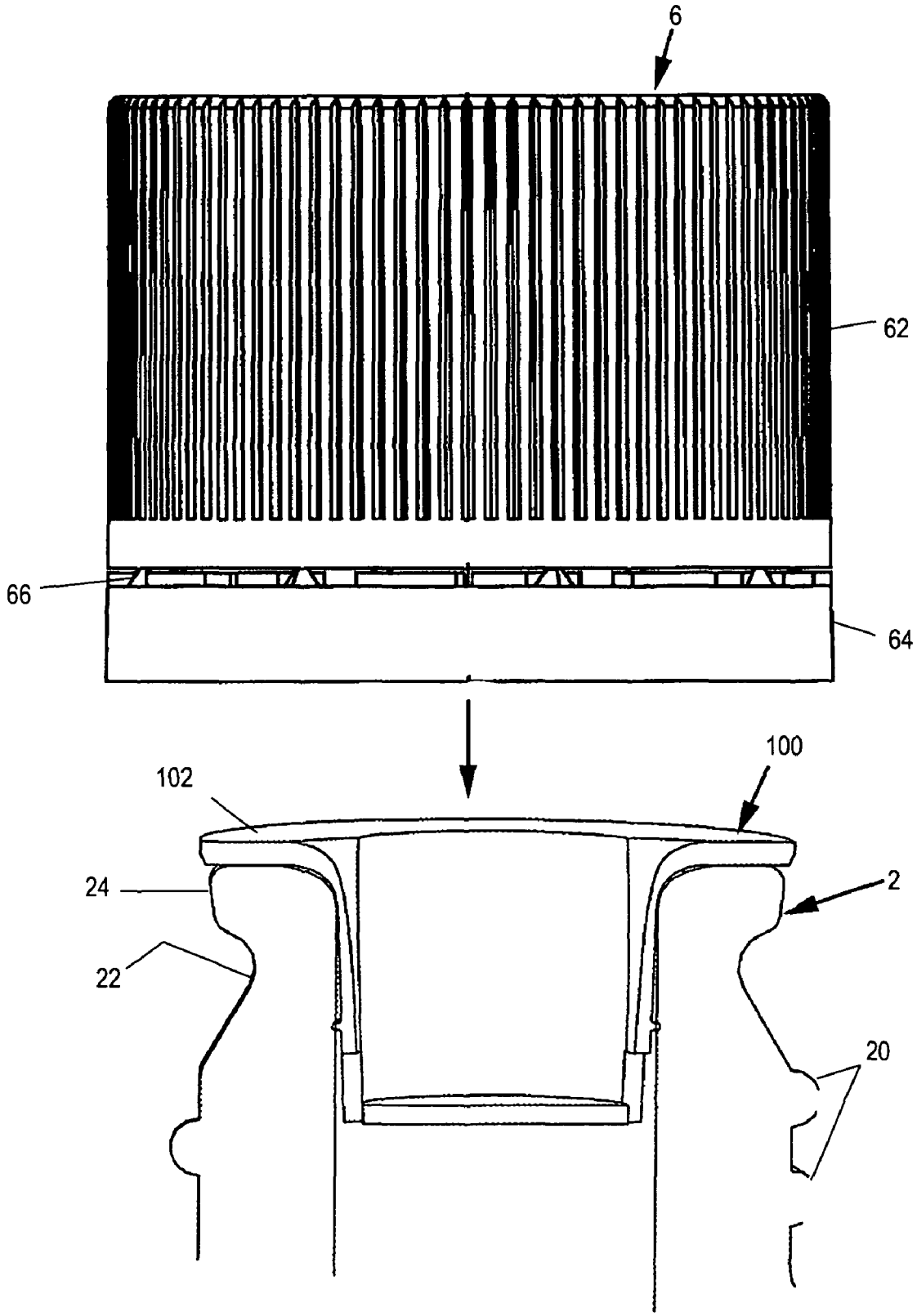
FIG. 1 is an exemplary embodiment of a tamper evident pour-out container neck 2, cap 6, and internal fitment 100 combination for improved pourability in accordance with the present invention.

Referring initially to FIG. 1, an exemplary embodiment of a tamper evident pour-out container, cap, and internal fitment combination for improved pourability is shown.

The body (not shown) of the container may be formed as any suitable receptacle for holding liquid, such as a carton, can, jar, or bottle, and may take any of a variety of shapes as a matter of design choice. The bottle may be formed of plastic, glass, or other known bottling materials. In the illustrated embodiment, the container is a bottle. The body of the container leads upward to a hollow substantially cylindrical neck 2 defined by a uniform cylindrical interior, and an exterior having series of screw-threads 20 for securing a tamper-evident cap 6, as will be described. The neck 2 terminates at a pronounced rim 24. The exterior of the cylindrical neck 2 of the bottle above the screw-threads is inwardly constricted at an angled taper 22, abruptly flaring outward to a pronounced rim 24.

In accordance with the present invention, a pour-out fitment 100 is inserted into the cylindrical interior of the neck 2 of the container, and is seated flush atop the rim 24. The pour-out fitment 100 is dimensioned to fit freely but snugly within the interior of the cylindrical neck 2. Preferably, the fitment 100 is made of a material that is flexible enough to create a pressure or friction fit within the neck 2, but rigid enough to remain in place and to not fall out under the pressure of the liquid within the container. Suitable materials include polymers, plastics, and elastomers. In the illustrated embodiment, the fitment 100 includes a substantially orthogonal top flange 102 that is generally annularly shaped. Flange 102 extends completely over the rim 24 of the container into which the fitment 100 is placed, but it does not extend past the rim's perimeter. Therefore, flange 102 does not obstruct application of the cap 6, and when cap 6 is secured onto the neck 2 the flange 102 becomes sandwiched between the cap 6 and the rim 24 of the container, providing a fluid seal.

The tamper evident cap 6 further comprises an upper portion 62 with internal threads and a frangible ring 64 attached to the upper portion 62 and indexed to the neck 2 of the container. The ring 64 is minimally attached to the upper portion 62 by frangible struts 66. When twisting the cap 6, the ring 64 remains stationary. Thus, the struts 66 break to release the cap 6, and thereby provide a ready tamper-indication as to whether the container has been opened. To maintain its stationery position, the ring 64 is defined by a series of inwardly-protruding radially-spaced ribs 68 (obscured in FIG. 1) that fit within conforming recesses 28 formed in the lower neck 2 of the container, albeit the ring 64 may be frictionally or otherwise indexed thereto.

Figure 2:
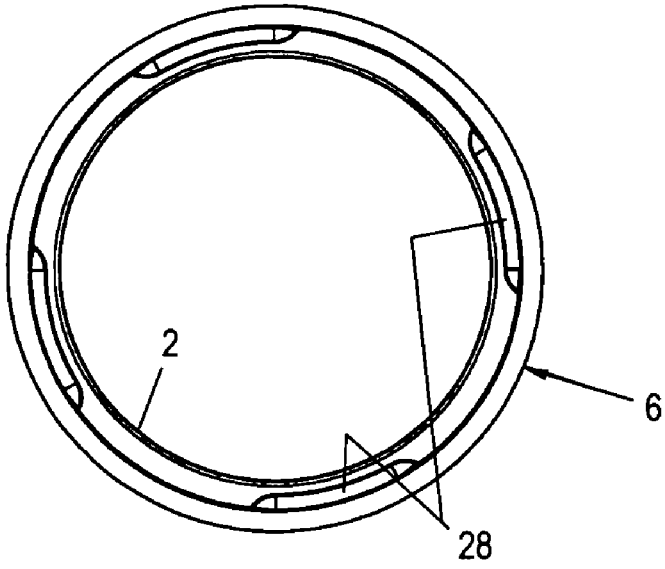
FIG. 2 is a bottom view of the temper evident cap 6.
Figure 3:
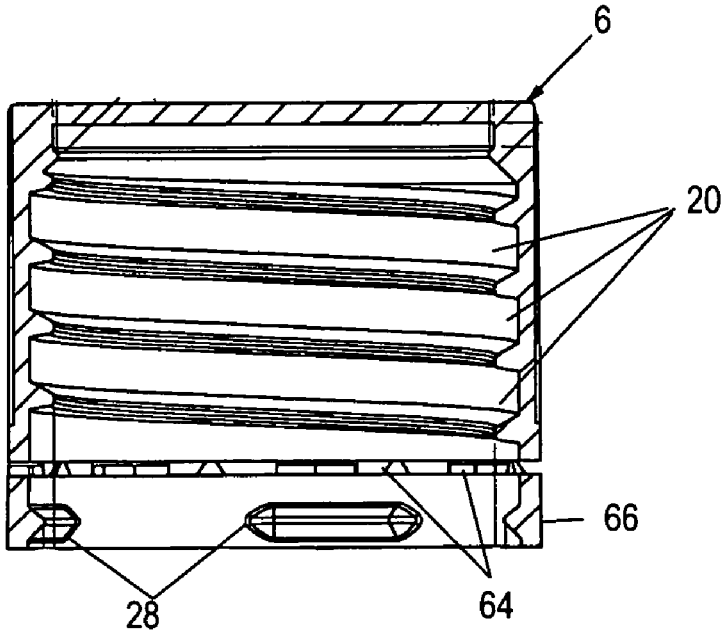
FIG. 3 is side cross-section view of the tamper evident cap 6 applied to the neck 2 of a container.

FIG. 2 is a bottom view of tamper evident cap 6, and FIG. 3 is side cross-section view of the tamper evident cap 6 applied to the neck 2 of a bottle. The neck 2 may be defined by a 110-120 degree screw thread 20 as shown. Just beneath the screw-threads 20 are a series of radially-spaced recesses 28 in the exterior wall of the neck 2—four evenly-spaced notches being well-suited. The upper portion 62 of the tamper evident cap 6 bears internal threads 61 conforming to the exterior threads 20 on the neck 2 of the container for engagement therewith. When the cap 6 is initially applied, the frangible ring 64 extends beneath the screw-threads 20. The ring 64 includes inwardly-protruding ribs 68 that jut into the recesses 28 formed in the neck 2 of the container. The ribs 68 and the recesses 28 have corresponding shapes, so the ribs 68 can engage the recesses 28 to ensure that the ring 64 does not rotate. As stated above, the ring 64 is only minimally attached by the frangible struts 66 to the upper portion 62 of the cap 6, and so upon twisting of the cap 6, the ring 64 remains stationery and the struts 66 break. This separation of the upper portion 62 and ring 64 provides tamper evidence.

Figure 4:
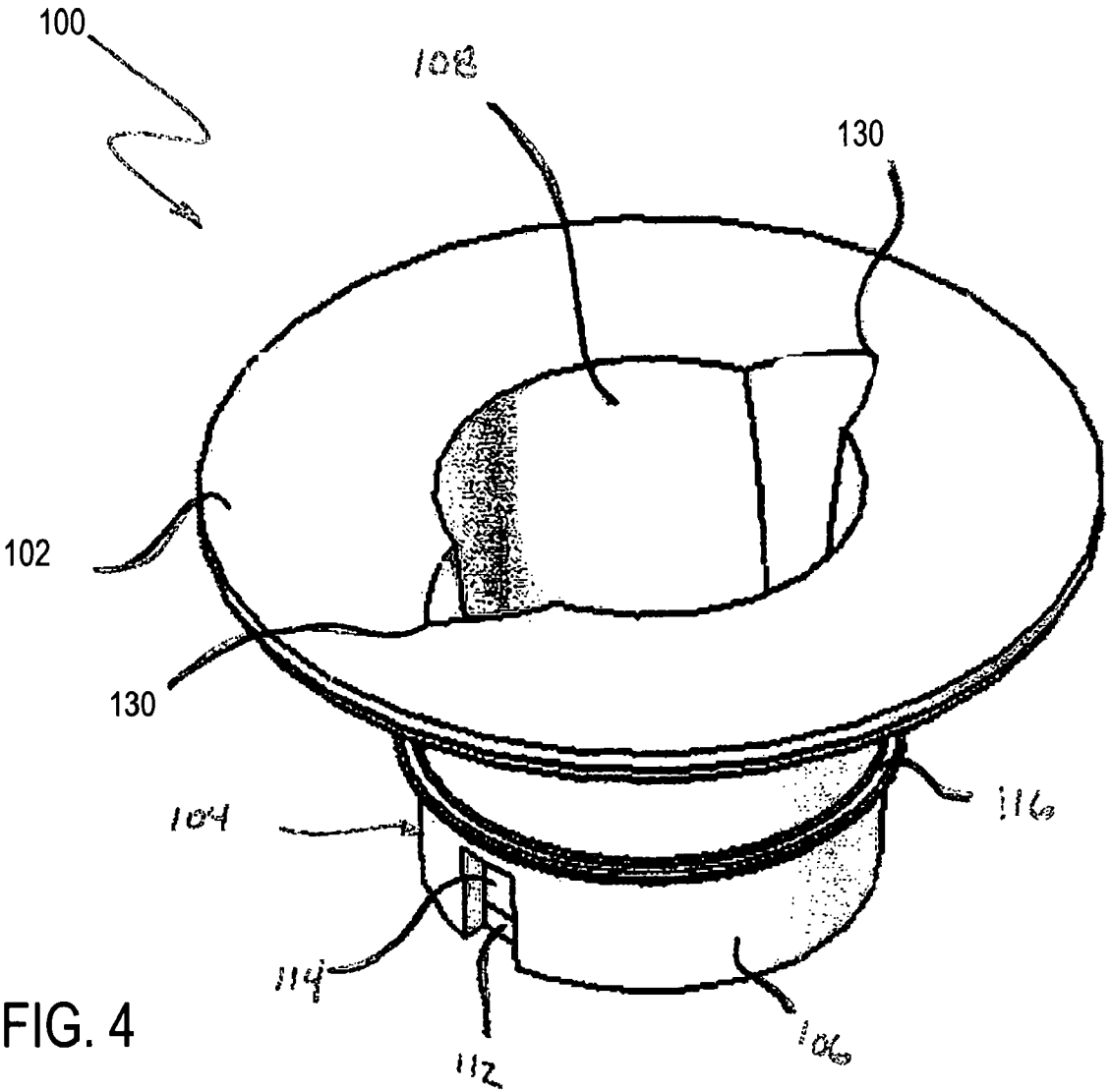
FIG. 4 is a top perspective view of an embodiment of the pour-out fitment 100 removed from the cylindrical interior of the neck 2 of the container.

FIG. 4 is a top perspective view of an embodiment of the pour-out fitment 100 removed from the cylindrical interior of the neck 2 of the container. The fitment 100 fits within the container neck 2 and beneath the cap 6. The fitment 100 has an annular top flange 102 for limiting insertion into the neck 2, and a neck insert 104 depending from top flange 102. The neck insert 104 comprises a cylindrical wall 106 attached to the inner diameter of top flange 102, and the neck insert 104 is capped at its distal end with a circular bottom 112. In an embodiment, a pair of opposing channels 130 is molded into the interior of the cylindrical wall 106. The channels 130 run to the top flange 102 for smoother pouring. At the bottom of the neck insert 104 are one or more small apertures for metering entry of liquid into the hollow interior. In an embodiment, the radial placement of the aperture(s) 114 conforms to that of the channels 130 so that the metered flow of liquid entering the insert 104 will flow along the channels 130. This enhances the ability of the fitment 100 to control and meter the flow of liquid out of the container. The channels 130 become gradually deeper toward the top of the neck insert 104 to define pouring spouts 132 on the top flange 102. This achieves a smooth and closely-controlled flow, especially suitable for dispensing medicines and ingredients used in cooking, and for perfume dispensing applications.

Figure 5:
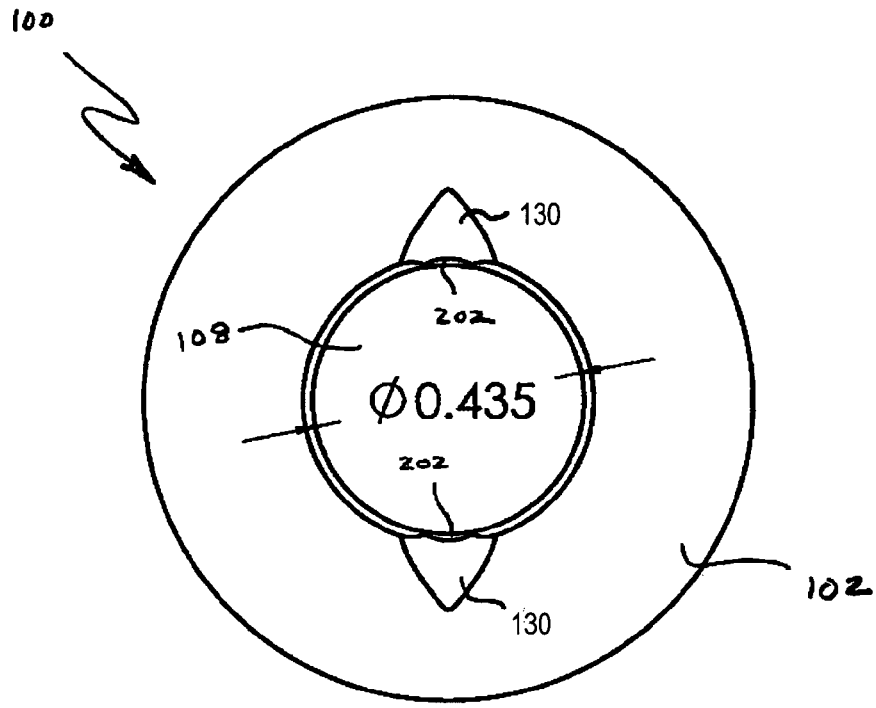
FIG. 5 is a top view of fitment 100.
Figure 6:
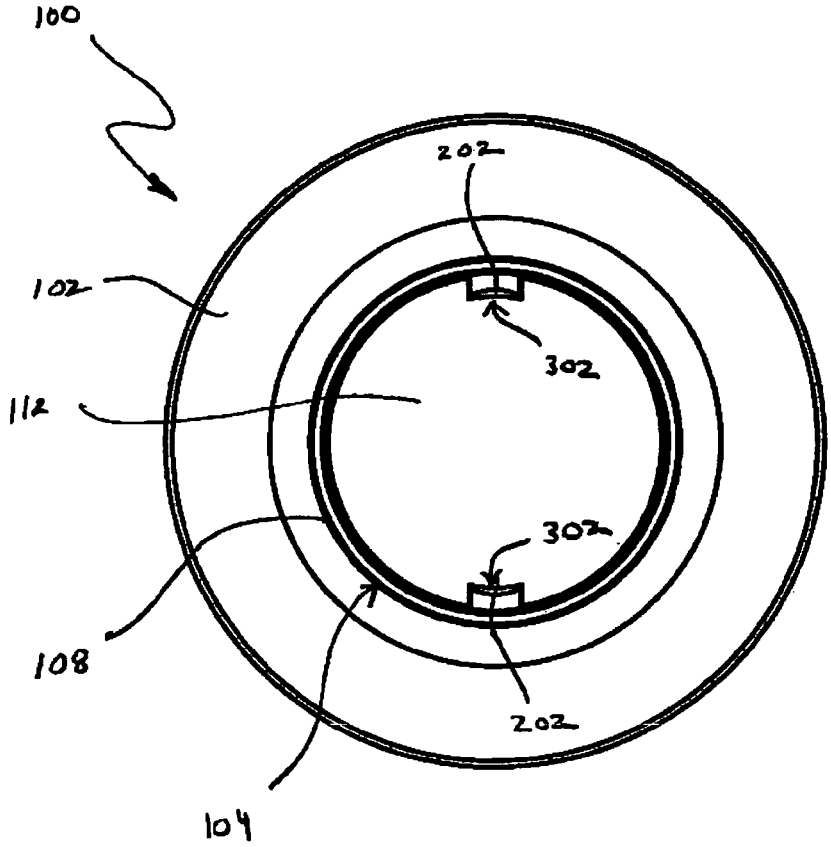
FIG. 6 is a bottom view of the fitment 100.
Figure 7:
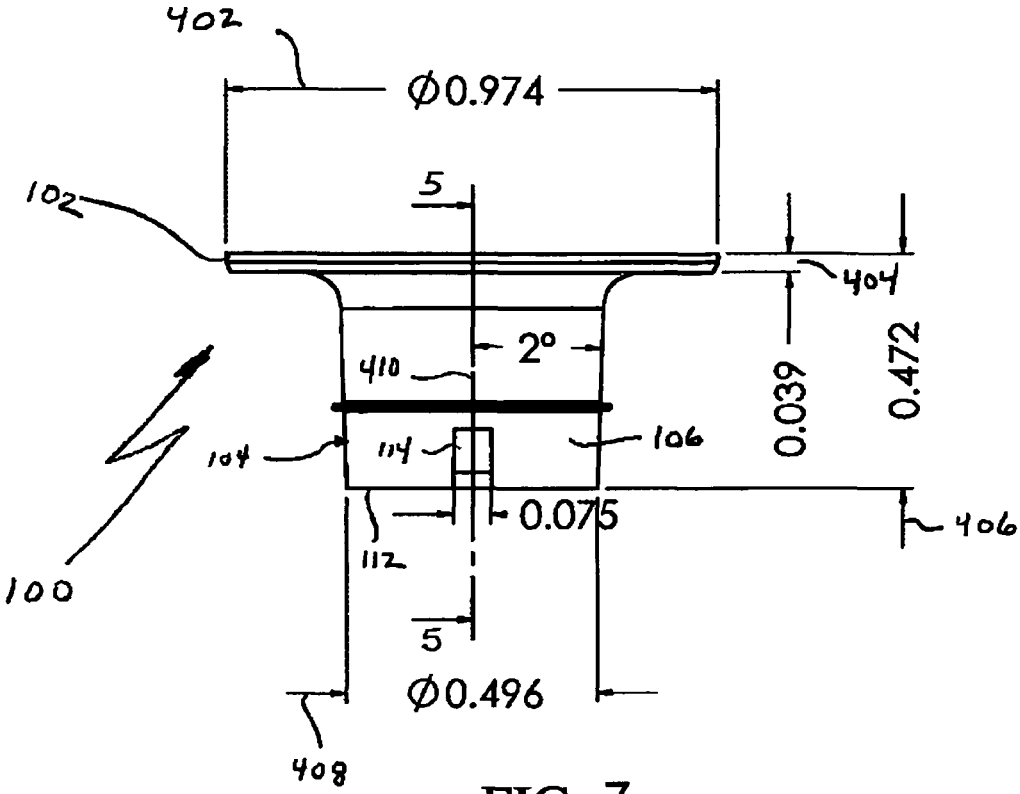
FIG. 7 is a side view of the fitment 100.
Figure 8:
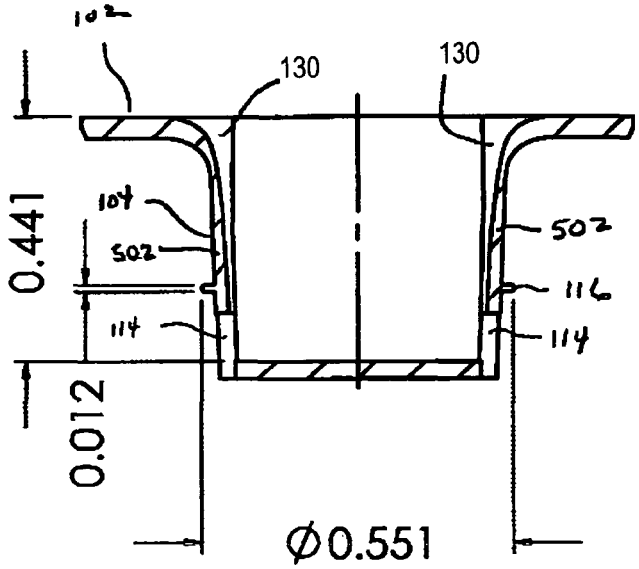
FIG. 8 is a cross-section view through line 5-5 of FIG. 7.

FIGS. 5 and 6 are a top view and bottom view of the fitment 100, respectively. FIG. 7 is a side view, and FIG. 8 is a cross-section view through line 5-5 of FIG. 7.

The cylindrical neck insert 104 is concentric with the top flange 102. In one embodiment, the neck insert 104 extends into the neck of the container by a distance 406 (FIG. 7) of approximately 0.5", preferably about 0.472". As illustrated collectively in FIGS. 7-8, the top flange 102 has an outer diameter 402 of approximately 1.0", preferably about 0.974", and a thickness 404 of about 0.039". The neck insert 104 includes a closed bottom 112 having a diameter of about 0.5", preferably about 0.496". The neck insert 104 is sized to be pressure or friction fit into the neck 2 of the container 2. Therefore, the insert 104 can be easily and repeatedly placed into and removed from the neck 2 of the container. In order to enhance the friction fit, the diameter of the neck insert 104, and in particular the diameter of the exterior of cylindrical wall 106, flairs outward from the closed bottom 112 to the top flange 102. In one embodiment, the exterior of the insert's cylindrical wall 106 forms an angle of about 2° with the central axis 410 of the cylindrical neck fitment 100. In an embodiment, a ring 116 outwardly extends from the exterior of cylindrical wall 106 of the neck insert 104. Although the ring 116 can be a separate structure that is attached to the cylindrical wall 106, preferably the ring 116 is formed or molded as a single structure with the exterior of the neck insert's cylindrical wall 106. In an embodiment, the ring 116 extends 360° around the exterior. In another embodiment, the ring 116 extends from the exterior by about 0.015" and has a thickness of about 0.012". The ring 116 can be located anywhere along the length of the fitment's neck insert 104 and provides additional frictional contact between the neck insert 104 and the interior of the neck 2. In one embodiment, the ring 116 is sized, shaped, and located to engage an annular recess that is formed or cut into the interior of a neck 2. This feature increases the engagement and seal between the fitment 100 and the container neck 2. In addition to a single ring 116, a plurality of rings can be used.

In an embodiment, the neck insert's cylindrical wall 106 comprises at least one aperture (e.g., a notch, hole, or slot) 114 that allows liquid to pass from the exterior of the neck insert 104 into its hollow interior. In an embodiment, there are two diametrically opposed apertures 114 at the cylindrical wall's distal end. Other arrangements and numbers of apertures 114 can also be used. In one embodiment, the apertures 114 are substantially square with a width dimension of about 2 mm or 0.075". In one embodiment, each aperture 114 extends from the closed bottom 112 of the neck insert and partially towards the top flange 102. As is best shown in FIGS. 5 and 8, the apertures 114 provide ingress of fluid at the bottom of the each channel 130, and the channels 130 extend from the top edge of the apertures 114 to the top flange 102. Note that the apertures 114 provide a direct opening and do not obstruct the flow of fluid into the channel 130. The annular ring 116 is located between the apertures 114 and the top flange 102.

Referring to FIGS. 4-5, in one embodiment, the inner diameter of the neck insert cylindrical wall 106 is approximately 0.435", and the interior of the cylindrical wall 106 comprises a channel 130 that corresponds to every aperture 114. The channel 130 begins at the aperture 114 and terminates at the top flange 102. In an embodiment, there are two diametrically opposed channels 130 that correspond to two diametrically opposed apertures 114. The channel 130 has a generally U- or V-shaped cross section. In one embodiment, the depth of channel 130 increases as the channel 130 extends towards the top flange 102, and the change in depth is accomplished by decreasing the thickness of the neck insert's cylindrical wall 106 and top flange 102. Decreasing the thickness prevents the need to increase the outer diameter or decrease the inner diameter of cylindrical wall 106 to accommodate the channels. The increased depth of the channels 130 in combination with the U- or V-shaped cross sections create pouring spouts 132 in top flange 102. Decreasing the wall thickness in combination with the aperture 114 defines a small passage or window 202 that is unobstructed by any portion of the fitment structure. The channels 130 provide for improved flow control and facilitate the use of the fitment to dispense liquids drop-by-drop. Inverting the bottle containing the fitment 100 allows a very small, metered, and controlled portion of the liquid to flow directly past the closed bottom 112 and cylindrical wall 106 and into the channel 130, which directs the liquid to the top flange 102 for dispensing.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singularly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A pour-out fitment for a cylindrical neck of a container, the fitment comprising:

an annular flange having a diameter spanning the neck of said container and abutting a rim of said neck to limit insertion, but not extending past a perimeter of said rim; and a neck insert depending from the annular flange and concentric therewith, said neck insert including, a cylindrical wall extending downward from the top flange to a substantially closed distal end, said cylindrical wall having at least one aperture proximate to the substantially closed distal end, and said cylindrical wall being defined by at least one channel running axially along the interior of the cylindrical wall from a corresponding aperture to said annular flange wherein said at least one channel increases in depth as it extends from the aperture to the top flange and wherein the thickness of the cylindrical wall and the top flange decreases to accommodate the increase in depth of said at least one channel.

2. The pour-out fitment for the neck of a container according to claim 1, wherein the neck insert further comprises a ring extending around the exterior of the cylindrical wall for frictional engagement with the neck.

3. The pour-out fitment for the neck of a container according to claim 2, wherein the ring is integral with the neck insert.

4. The pour-out fitment for the neck of a container according to claim 1, wherein the at least one aperture and the at least one channel in the cylindrical wall of said neck insert comprise a pair of diametrically opposed apertures and a pair of diametrically opposed channels that corresponds to said apertures.

5. The pour-out fitment for the neck of a container according to claim 4, wherein the pair of channels have one of a U- or V-shaped cross section.

6. The pour-out fitment for the neck of a container according to claim 1, wherein the pour-out fitment comprises polymers or plastics.

7. The pour-out fitment for the neck of a container according to claim 6, wherein the neck insert is sized to pressure-fit within the neck of the container.

8. A tamper-evident and pour-out assembly for a container having a hollow cylindrical neck with external threads, comprising:

a tamper-evident cap, including, a top-enclosed upper portion having a cylindrical wall with internal threads for engagement with the external threads on the neck; and a circular ring attached to the upper portion by frangible struts, having radially spaced ribs that protrude inwardly to engage with recesses in the neck to prevent the circular ring from rotating when the upper portion is twisted; and an annular flange having a diameter spanning the neck of said container and abutting a rim of said neck to limit insertion, but not extending past a perimeter of said rim; and a neck insert depending from the annular flange and concentric therewith, said neck insert including a cylindrical wall extending downward from the top flange to a distal end, at least one aperture proximate to the distal end, and at least one channel running axially along the interior of the cylindrical wall from a corresponding aperture to said annular flange wherein said at least one channel increases in depth as it extends from the aperture to the top flange and wherein the thickness of the cylindrical wall and the top flange decreases to accommodate the increase in depth of said at least one channel ;

whereby the tamper-evident cap secures the pour-out fitment within the neck when applied to the container.

9. The tamper-evident and pour-out apparatus according to claim 8, wherein the neck insert of the pour-out fitment further comprises at least one ring of flexible material extending around the exterior of the cylindrical wall for frictional engagement with an inside surface of the neck, whereby said ring flexes to compensate for variation in the inside diameter of said neck and maintain sealed engagement therewith.

10. The tamper-evident and pour-out apparatus according to claim 9, wherein the ring is integral with the neck insert.

11. The tamper-evident and pour-out apparatus according to claim 8, wherein the neck insert comprises a pair of diametrically opposed apertures and a pair of diametrically opposed channels that corresponds to the apertures.

12. The tamper-evident and pour-out apparatus according to claim 11, wherein the pair of channels have a U- or V-shaped cross section.

13. The tamper-evident and pour-out apparatus according to claim 8, wherein the pour-out fitment comprises polymers or plastics.

14. The tamper-evident and pour-out apparatus according to claim 13, wherein the neck insert is sized to be pressure fit within the neck of the container.

15. The tamper-evident and pour-out apparatus according to claim 9, wherein the at least one ring of flexible material is located between said annular flange and said at least one aperture proximate to the distal end.

* * * * *